US007107861B2

(12) United States Patent
Nakamura

(10) Patent No.: US 7,107,861 B2
(45) Date of Patent: Sep. 19, 2006

(54) ENCODER

(75) Inventor: Yoshiyuki Nakamura, Kanagawa-ken (JP)

(73) Assignee: Dr. Johannes Heidenhain GmbH, Traunreut (DE)

( * ) Notice: Subject to any disclaimer, the term of this patent is extended or adjusted under 35 U.S.C. 154(b) by 0 days.

(21) Appl. No.: 10/964,528

(22) Filed: Oct. 13, 2004

(65) Prior Publication Data

US 2005/0081648 A1 Apr. 21, 2005

(30) Foreign Application Priority Data

Oct. 16, 2003 (JP) ..... 2003-355775

(51) Int. Cl.
*G04L 3/02* (2006.01)

(52) U.S. Cl. ..... 73/862.325

(58) Field of Classification Search ..... 73/862.325, 73/862.193, 862.321
See application file for complete search history.

(56) References Cited

U.S. PATENT DOCUMENTS 5,533,410 A * 7/1996 Smith ..... 73/862.193
5,780,751 A * 7/1998 Nomerange et al. ... 73/862.325
6,118,643 A 9/2000 Dyer et al.

FOREIGN PATENT DOCUMENTS

| | | |
|---|---|---|
| JP | 59-26882 U1 | 2/1988 |
| JP | 09-243409 | 9/1997 |
| JP | 63-181813 U1 | 11/1998 |
| JP | 2002-151192 | 5/2002 |

* cited by examiner

*Primary Examiner*—Jewel V. Thompson
(74) *Attorney, Agent, or Firm*—Kenyon & Kenyon LLP

(57) ABSTRACT

An encoder includes an encoder body adapted to detect the rotation of an object to be measured, a cover that covers a rear part of the encoder body, and a connector that connects an inner circuit of the encoder body to an outer circuit. The connector is mounted on the cover by a change direction adaptor, which makes it possible to change the connection direction of the connector with a single cover.

16 Claims, 4 Drawing Sheets

ENCODER

CROSS-REFERENCE TO RELATED APPLICATIONS

The present application claims priority to application Ser. No. 2003-355775, filed in Japan on Oct. 16, 2003, which is expressly incorporated herein in its entirety by reference thereto.

FIELD OF THE INVENTION

The present invention relates to an encoder. More particularly, the present invention relates to an encoder in which a connector coupling structure is mounted on a cover of the encoder which is coupled to the rotation axis of a rotating element for motors and detects the number of revolutions and/or the rotation angle and location of the rotating element.

BACKGROUND INFORMATION

Certain conventional encoders are connected to an external control circuit, etc., via a connector for deriving output signals or inputting/outputting control signals. For a structure of such a connector, for example, reference is made to FIGS. 4 and 5. The structure illustrated in FIG. 4 has a connector 4 coupled to the posterior part of encoder cover 2 mounted on an encoder body 1. That is to say, the connector is coupled to the encoder cover from the upper side. Connector 4 is coupled to cover 2 through gasket 42 for maintaining air tightness inside of the body. The geometry of cover 2 is generally adapted to match the geometry of the encoder body, for example, a cylindrical shape with one end closed, a squarish box shape, etc.

Encoder body 1 has components for detecting the number of revolutions or the rotation angle of a rotating element, such as a servomotor. Specifically, the body 1 has rotation axis 1*b* placed at part 1*a* of body 1. A coding plate is attached to this rotation axis 1*b*, in which a light transmitting area and a light shielding area are formed in a predetermined pattern. A light source is provided for irradiating light to the pattern-forming parts of this coding plate. A light sensor receiving light transmitted through the coding plate is arranged opposite of the light source with the coding plate arranged therebetween. An electronic circuit is provided for outputting an electric signal corresponding to the rotation angle. The rotation axis 1*b* is attached to the rotation axis of the rotating element to be measured, e.g., by a conventional device, and, then, the rotation action of the rotating element will be transmitted to the rotation axis 1*b*.

In the structure illustrated in FIG. 5, connector 4 is attached to the side part of encoder cover 2. That is to say, in this structure, the connector is coupled from the side. The arrangement of the rest of the components of the structure is similar to that illustrated in FIG. 4.

An encoder outputting the output signals of the encoder via a connector directly fixed on an electric member is described, for example, in Japanese Published Patent Application No. 9-243409. Furthermore, an encoder in which a connector is integrated with a cover is described, for example, in Japanese Published Patent Application No. 2002-151192.

In this manner, the direction to connect the connector from the rear part as illustrated in FIG. 4, from the side part as illustrated in FIG. 5, or from another direction such as diagonally, backward, etc., depends on an apparatus to which the connector is coupled or a customer's specifications. Therefore, since a number of covers 2 may need to be provided for each type of encoder to correspond to the apparatus to which the encoder to be attached or the customer's specification, cost reduction in this technology is not believed to have been sufficiently achieved. Moreover, even if the specification of an encoder body is matched, the cover may have to be redesigned, which may lead to a considerable delay of delivery or possible loss of the customer. Such a problem may more pronounced, e.g., with recent rapid development in apparatus technology and control devices.

SUMMARY

According to an example embodiment of the present invention, an encoder may include a structure that makes it possible to take the connector out from the body in several directions with one type of cover.

According to an example embodiment of the present invention, a change direction adaptor is provided between a connector and a cover, e.g., to provide the configuration described in more detail below.

According to an example embodiment of the present invention, an encoder includes: an encoder body adapted to detect rotation of an object to be measured; a cover arranged to cover a rear part of the encoder body; a connector configured to connect an internal circuit of the encoder body with an external circuit; and a change direction adaptor configured to mount the connector to the cover in a plurality of connection directions between the connector and the cover.

The cover may include a coupling part, and the change direction adaptor may be mountable to the coupling part.

The coupling part may be arranged at an angle one half of an angle between two connection directions.

The connection direction may be changeable in accordance with a direction of mounting of the change direction adaptor to the coupling part of the cover.

The change direction adaptor may include a coupling part that is complementary to the coupling part of the cover.

The encoder may include a seal device arranged between the cover and the change direction adaptor.

The cover and the change direction adaptor may include symmetric openings arranged to be in alignment in each of the connection directions.

The cover and the change direction adaptor may include complementary coupling parts.

The coupling part(s) may be substantially planar, curved, etc.

The connector may be arrangeable substantially parallel and/or substantially perpendicular to a rotation axis of the object to be measured.

According to an example embodiment of the present invention, an encoder may include: encoder body means for detecting rotation of an object to be measured; covering means for covering a rear part of the encoder body means; connecting means for connecting an internal circuit means of the encoder body means with an external circuit means; and change direction adapting means for mounting the connecting means to the covering means in a plurality of connection directions between the connecting means and the covering means.

DETAILED DESCRIPTION

Figure 1:
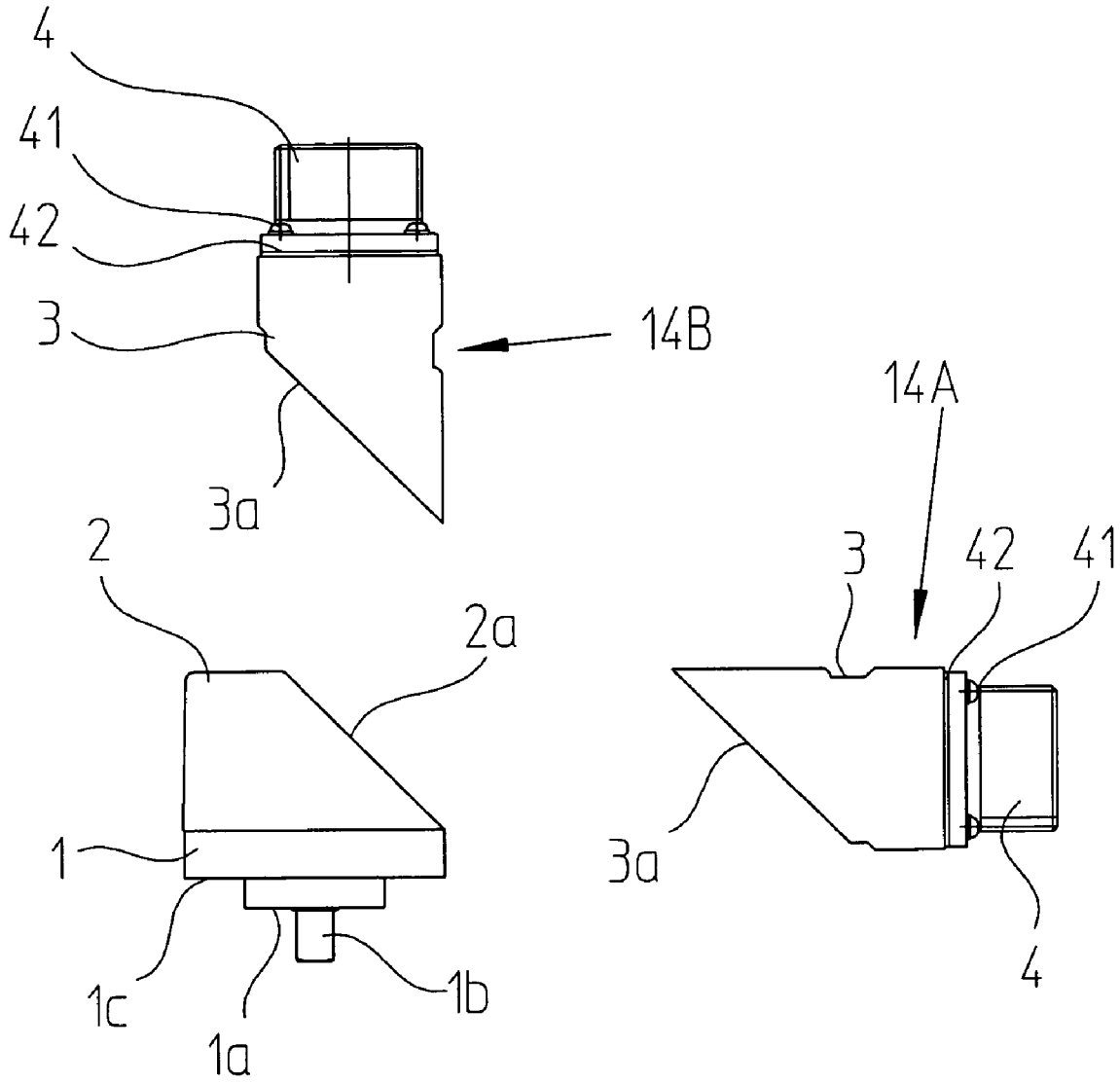
FIG. 1 is a front elevation view of an example embodiment of an encoder.

An encoder includes an encoder body 1 configured to detect the rotation of an object to be measured. A cover 2 covers the rear part of the encoder body 1. A connector 4 is provided to connect an inner circuit of the encoder body 1 and an outer circuit, in which the connector 4 is mounted to the cover 2 via a change direction adaptor 3, the attachment direction of which is changeable.

The cover 2 includes a coupling part 2*a* to which the change direction adaptor 3 is mounted.

The angle of the coupling part 2*a* is one half of the angle to be changed.

The change direction adaptor 3 changes the attachment direction of the connector 4 by changing the direction of mounting to the coupling part 2*a*.

Thus, the encoder includes a structure that makes it possible to take the connector 4 out to a plurality of directions with one type of cover 2.

For example, it may be achieved that common parts are applied without changing encoder covers 2 by the change direction adaptor 3 providing a change of attachment directions, thereby, e.g., contributing to cost reduction.

The attachment direction of the connector 4 may be easily changed since the coupling part 2*a* is provided in the encoder and the change direction adaptor 3 is mounted thereto.

Moreover, the attachment direction of the connector 4 may be changed by only changing the attachment direction of the change direction adaptor 3, which may be economical.

Thus, an encoder includes: an encoder body 1 arranged to detecting the rotation of the object to be measured; a cover 2 covering the rear part of the encoder body 1; and a connector 4 connecting the inner circuit of encoder body 1 and the outer circuit, in which the connector 4 is mounted to the cover 2 via a change direction adaptor 3, the attachment direction of which is changeable. Furthermore, the cover 2 may have a coupling part 2*a* to which the change direction adaptor 3 may be mounted. The change direction adaptor 3 changes the attachment direction of the connector 4 by changing the direction of mounting to the cover coupling part 2*a*.

FIG. 1 is a front view illustrating an example embodiment of an encoder. As illustrated in FIG. 1, the encoder includes body 1 having a rotation axis 1*b* arranged at an extension part 1*a*, and a cover 2 covering the rear part of the body 1, i.e., the part where measuring components of the encoder are placed. Furthermore, connector 4 is attached to the cover 2 via the change direction adaptor 3. The extension part 1*a* may be eliminated depending upon the configuration of the encoder.

The rear part of the body 1 of the encoder has component (s) to detect the number of revolutions or the angle of rotation of a rotating element, e.g., a servomotor. For example, a coding plate may be engaged with the rotation axis 1*b*, in which a light transmitting area and a light shielding are area formed in a predetermined pattern. A light source may be provided for irradiating light to the pattern-forming parts of the coding plate, and a light sensor may be provided for receiving light transmitted through the coding plate and arranged opposite to the light source with the coding plate sandwiched therebetween. An electronic circuit may be provided for outputting an electric signal corresponding to the rotation angle. The rotation axis 1*b* may be engaged with the rotation axis of the rotating element to be measured, e.g., by a conventional device, and, thus, rotation of the rotating element will be transmitted to the rotation axis 1*b*.

Moreover, the body 1 may include a magnetic pattern generating device arranged to generate a predetermined magnetic pattern by the rotation of a rotating element, and magnetism detecting elements may be provided to detect changes in the magnetic field of the magnetic pattern generating device caused by the rotation of the rotating element and to output electric signals corresponding to the angle of rotation. Alternatively, other detection arrangements, e.g., a device for detection of an angle of rotation based on static electricity, mechanical contacts, etc., may be provided, or combinations of the detection arrangements described herein may be provided.

Encoder cover 2 has coupling part 2*a* to couple to the change direction adaptor 3, and the change direction adaptor 3 with the connector 4 is arranged to couple or engage to or with the coupling part 2*a*. Coupling part 2*a* may be diagonally notched as illustrated in the Figures. By forming such a coupling part 2*a*, it may be easy to change directions between the rotation axis 1*b* and the connector 4 by the change direction adaptor 3. The angle of the coupling part 2*a* may be 45° so that the angle between the rotation axis 1*b* or attachment surface 1*c* of the encoder body 1 and the connector 4 may be changeable by 90°. That is, the angle of the coupling part 2*a* may be one half the desired angular directional change between the rotation axis 1*b* or the attachment surface 1*c* of the encoder body 1 and the connector 4. As an additional example, if the angle between the rotation axis 1*b* or attachment surface 1*c* of the encoder body 1 and the connector 4 is to be changeable by approximately 60°, the angle of the coupling part 2*a* may be approximately 30°. It should be understood that the foregoing examples are merely exemplary and are not intended to be limiting. That is, the angle of the coupling part 2*a* may have any desired value, e.g., based on the desired angular directional changeability between the rotation axis 1*b* or attachment surface 1*c* of the encoder body 1 and the connector 4.

Furthermore, for the shape or geometry of the coupling part 2*a*, the coupling part 2*a* may be substantially planar, as illustrated, or may have, e.g., a curved or arced profile, etc.

The front part of change direction adaptor 3 has coupling part 3*a* for coupling to coupling part 2*a* of the cover 2. The coupling part 3*a* may be arranged in a similar or complementary manner as the coupling part 2*a* of the cover 2. For example, the angle of the coupling part 3*a* may be the same as the angle of the coupling part 2*a*. A gasket or packing may be provided between the coupling part 2*a* and the coupling part 3*a* to keep the interior of encoder air tight or to prevent any invasion of dust or liquid, etc.

The rear part of change direction adaptor 3 is provided with connector 4 by screw 41 through gasket or packing 42 for keeping the interior air tight or preventing any invasion of dust or liquid. Connector 4 is arranged to transmit encoder output signals or output/input of control signals between the inner circuit of the encoder body components and the outer control circuit. That is, the connector 4 connects the inner circuit of the encoder with the outer circuit. Any shape and any number of terminals may be provided and correspond to specifications of the encoder and/or the outer control circuit.

Change direction adaptor 3 and connector 4 together provide a connector assembly 14. By changing the attaching direction of the assembly 14, the attaching direction of the connector 4 may be varied. In the example embodiment illustrated in the Figures, assembly 14A indicates a transverse direction of the attaching direction, and assembly 14B indicates the longitudinal direction of the attaching direction. In this manner, the direction of the connector may be changed to a right angle (90°) by changing the attaching direction of assemblies 14A, 14B. The shapes of the coupling part 2*a* and coupling part 3*a* may be symmetrical to adapt to such different attaching directions.

Moreover, various attaching directions may be provided by various change direction adaptors 3 having different configurations, e.g., having different angles of the coupling part 3*a*.

Figure 2:
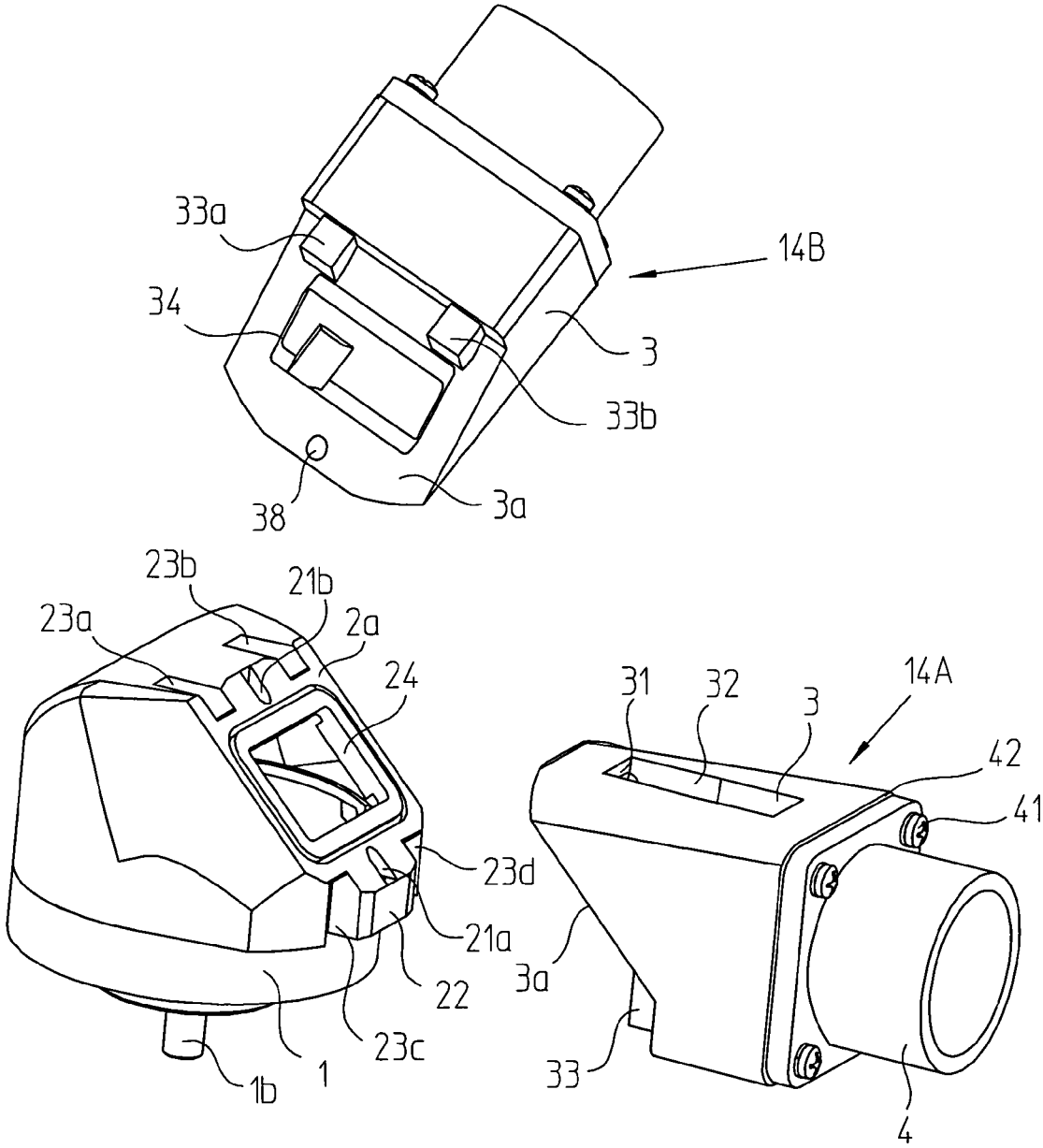
FIG. 2 is a perspective view of an example embodiment of an encoder.
Figure 3:
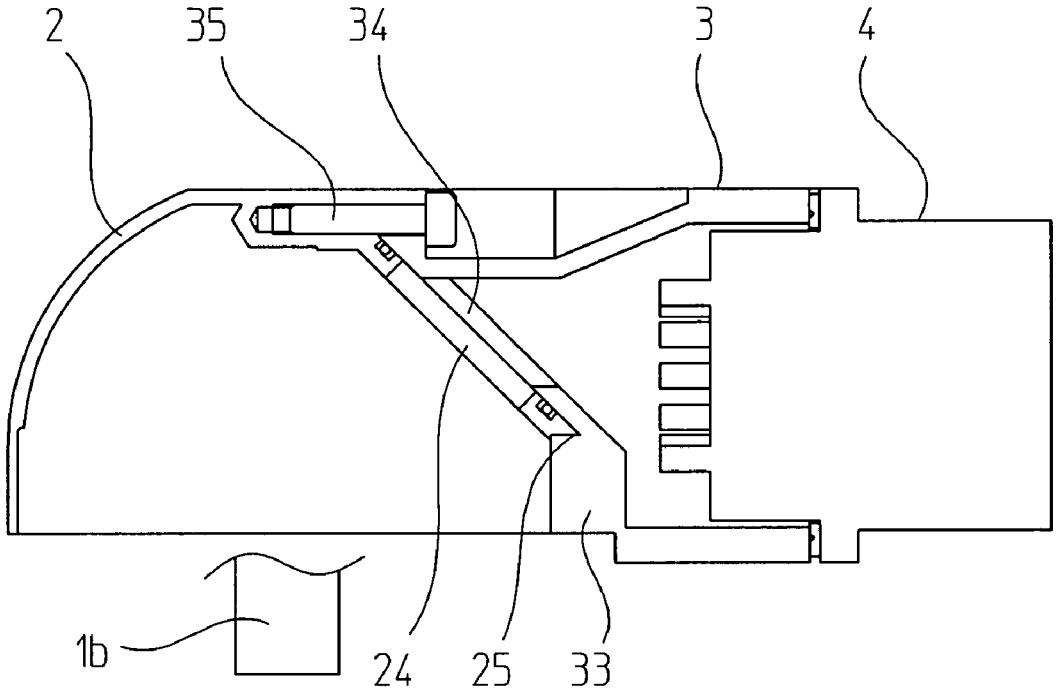
FIG. 3 is a cross-sectional view of the encoder illustrated in FIG. 2.
Figure 4:
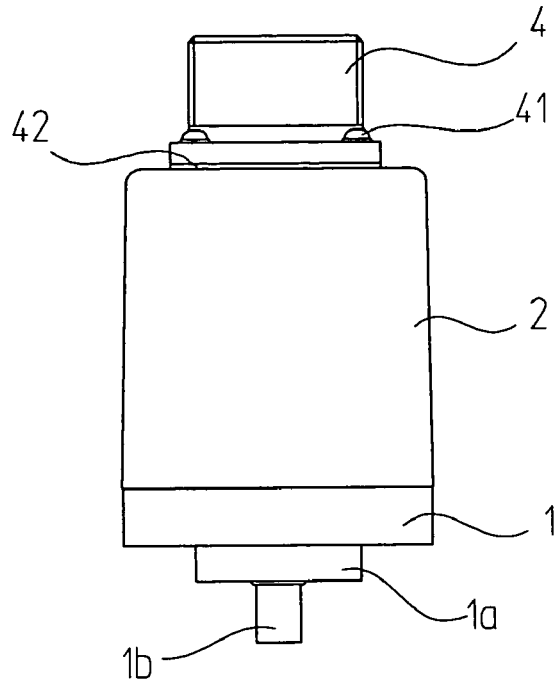
FIG. 4 is a schematic front elevation view illustrating an example of a conventional encoder.
Figure 5:
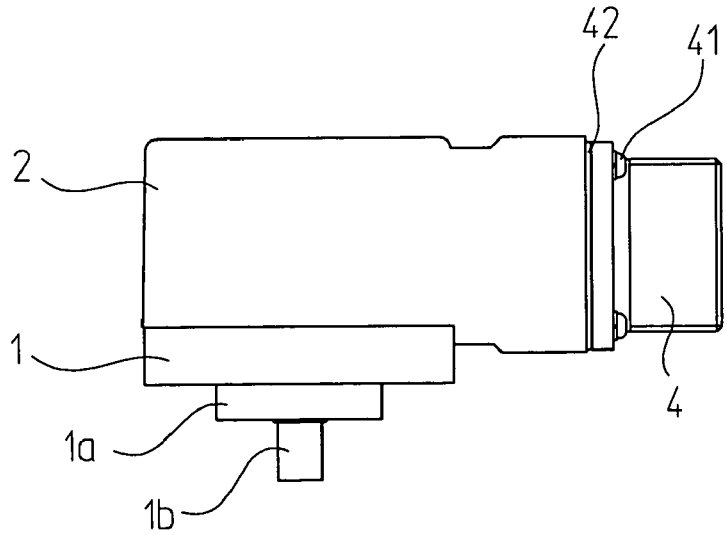
FIG. 5 is a schematic front elevation view illustrating an example of a conventional encoder.

FIG. 2 is a perspective view illustrating an example embodiment of an encoder of the present invention. FIG. 3 is a cross-sectional view of the encoder illustrated in FIG. 2, including axis of rotation 1*b* in the state when connector 4 is mounted in the transverse direction.

In FIGS. 2 and 3, the main structural components are the same as those illustrated in FIG. 1. Thus, the same components having the same numerical numbers are not explained. In this example, cover 2 and change direction adaptor 3 mounted on encoder body 1 have further features. Cover 2 has a peripheral part fitting to the outer shape of body 1 and a back end part that is closed with a circular arc from the peripheral part. Moreover, the coupling part 2*a* having an angle of 45° is provided. The cover 2 and the change direction adaptor 3 are arranged so that when the cover 2 and the change direction adaptor 3 are coupled, a structure having the appearance of a substantially integral device is provided.

The surface of coupling part 2*a* has substantially rectangular opening 24 with its four corners rounded. The wiring that connects the circuitry of the measuring components of the encoder body 1 with the connector 4 mounted on change direction adaptor 3 passes through the opening 24, and a user may make adjustments of, e.g., a trimmer, etc., inside of the body via the opening 24. Grooves for receiving a gasket or packing (e.g., an o-ring) are provided at the periphery of opening 24 to keep the interior of the encoder air tight or to prevent invasions of dust or liquid.

Furthermore, threaded holes 21*a*, 21*b* are provided to fix change direction adaptor 3 around the center and above and below the opening 24. The threaded holes 21*a*, 21*b* may be employed, as described below, depending on the direction of the attachment of the change direction adaptor 3. Moreover, a pair of key ways 23*a*, 23*b* are formed in the cover 2. Further, at the position which is rotationally symmetric to key ways 23*a*, 23*b* and the center of the opening 24 and the lower side of opening 24, similar key ways 23*c*, 23*d* are provided.

Change direction adaptor 3 has a substantially square profile, and the coupling part 3*a* has a coupling surface having an angle of approximately 45° to the central axis of the change direction adaptor 3. The both ends of the profile of the change direction adaptor 3 are chamfered so that the cut becomes deeper from the back end to the fore end, thereby integrating with the configuration of the cover 2.

Opening 34 of the coupling part 3*a* of the change direction adaptor 3 may have the same geometry as the opening 24 of the coupling part 2*a* of the cover 2 so that when the change direction adaptor 3 is mounted to the cover 2, opening 24 of cover 2 is aligned with the opening 34. Further, a pair of projecting index parts 33*a*, 33*b* are provided at the position corresponding to the key way 23*a*, 23*b* and projecting part 22.

Connector 4 is attached to the change direction adaptor 3 by screws 41 and gasket 42 at the rear part of change direction adaptor 3.

Change direction adaptor 3 and connector 4 together provide connector assembly 14 as illustrated in FIG. 1. In the Figures, assembly 14A is illustrated in the state of being attached from the side part of the encoder, i.e., in the transverse direction, and assembly 14B is illustrated in the state of being attached from the rear part of the encoder, i.e., in the longitudinal direction. Thus, the two assemblies 14A, 14B are illustrated in the Figures to illustrate different attachment directions from the transverse and longitudinal directions. It should be understood that one assembly 14A, 14B is attached to the cover 2. Further, it should be understood that assembly 14A and assembly 14B have the same components with different attachment directions.

When assembly 14A is attached to the body from the transverse direction, projecting part 22 of cover 2 is placed between index parts 33*a*, 33*b* of change direction adaptor 3. Then, these index parts 33*a*, 33*b* are contained in a recess formed by step part 25 arranged at the lower side of opening 34 of the cover as illustrated in FIG. 3. At this time, the openings 24, 34 are aligned with each other, and screw hole 31 of the change direction adaptor 3 and threaded hole 21*b* of the upper part of cover 2 are aligned with each other. A screw 35 is provided through screw hole 31 to threaded hole 21*b* via recess 32 of change direction adaptor 3. Via the screw connection, e.g., at one position, and engaged index part 33*a*, 33*b* and step part 25, assembly 14A is rigidly fixed to cover 2.

When assembly 14B is attached to the body from the upper side, i.e., in the longitudinal direction, index parts 33*a*, 33*b* are received in key ways 23*a*, 23*b* of cover 2. Since the openings 24, 34 are vertically and laterally axially symmetric, the opening parts 24, 34 are aligned with each other, and screw hole 31 and threaded hole 21*a* of the lower part of cover 2 are aligned with each other. Screw 35 is provided through screw hole 31 to threaded hole 21*b* via recess 32 of change direction adaptor 3. Via the screw connection, e.g., at one position, and engaged index part 33*a*, 33*b* and step part 25, assembly 14B is rigidly fixed to cover 2.

As described in above, by providing change direction adaptor 3, the attachment direction of the connector 4 may be varied without modifying the configuration of encoder cover 2. Furthermore, the configuration of the coupling part(s) 2*a*, 3*a* may be an angle of one-half of the angle of the change in direction, thereby the direction of connection of the connector 4 from the body 1 may be varied by changing the attachment direction of the change direction adaptor 3.

The foregoing may be applied to optical, magnetic, etc., encoders, and the encoder may be adapted to various types of apparatuses having different configurations or specifications. A reduction of manpower and cost may be obtained.

In the above example, though the encoder having axis 1*b* has been explained, it should be understood that the encoder hereof is not limited thereto. In this regard, example embodiments of the present invention may be applicable to a wide variety of encoders.

LIST OF REFERENCE CHARACTERS

1 encoder body
1*a* extension part

1*b* axis of rotation
1*c* attachment surface
2 cover
2*a* coupling part
3 change direction adaptor
3*a* coupling part
4 connector
14 connector assembly
14A connector assembly
14B connector assembly
21*a* threaded hole
21*b* threaded hole
22 projecting part
23*a* key way
23*b* key way
23*c* key way
23*d* key way
24 opening
25 step part
31 screw hole
33*a* index part
33*b* index part
34 opening
35 screw
41 screw
42 gasket

What is claimed is:

1. An encoder, comprising:

an encoder body adapted to detect rotation of an object to be measured;

a cover arranged to cover a rear part of the encoder body;

a connector configured to connect an internal circuit of the encoder body with an external circuit; and a change direction adaptor configured to mount the connector to the cover in a plurality of connection directions between the connector and the cover.

2. The encoder according to claim 1, wherein the cover includes a coupling part, the change direction adaptor mountable to the coupling part.

3. The encoder according to claim 2, wherein the coupling part is arranged at an angle one half of an angle between two connection directions.

4. The encoder according to claim 3, wherein the connection direction is changeable in accordance with a direction of mounting of the change direction adaptor to the coupling part of the cover.

5. The encoder according to claim 2, wherein the change direction adaptor includes a coupling part that is complementary to the coupling part of the cover.

6. The encoder according to claim 1, further comprising a seal device arranged between the cover and the change direction adaptor.

7. The encoder according to claim 1, wherein the cover and the change direction adaptor include symmetric openings arranged to be in alignment in each of the connection directions.

8. The encoder according to claim 2, wherein the coupling part is substantially planar.

9. The encoder according to claim 5, wherein the coupling part of the cover and the coupling part of the change direction adaptor are substantially planar.

10. The encoder according to claim 1, wherein the cover includes a coupling part and the change direction adaptor includes a coupling part, and wherein the coupling parts of the cover and the change direction adaptor mountable to each other and complementary.

11. The encoder according to claim 10, wherein the coupling part of the cover and the coupling part of the change direction adaptor are substantially planar.

12. The encoder according to claim 10, wherein the coupling part of the cover and the coupling part of the change direction adaptor are curved.

13. The encoder according to claim 1, wherein in a first connection direction, the connector is arranged substantially parallel to a rotation axis of the object to be measured.

14. The encoder according to claim 13, wherein in a second connection direction, the connector is arranged substantially parallel to the rotation axis of the object to be measured.

15. The encoder according to claim 1, wherein in a first connection direction, the connector is arranged substantially perpendicular to a rotation axis of the object to be measured.

16. An encoder, comprising:

encoder body means for detecting rotation of an object to be measured;

covering means for covering a rear part of the encoder body means;

connecting means for connecting an internal circuit means of the encoder body means with an external circuit means; and change direction adapting means for mounting the connecting means to the covering means in a plurality of connection directions between the connecting means and the covering means.

* * * * *